US010537186B2

(12) United States Patent
Rensink

(10) Patent No.: US 10,537,186 B2
(45) Date of Patent: Jan. 21, 2020

(54) UPCYCLED MATTRESS NUCLEUS OF ESSENTIAL FOAM ELEMENTS

(71) Applicant: Denver Mattress Co., LLC, Denver, CO (US)

(72) Inventor: Bob Rensink, Denver, CO (US)

(73) Assignee: Denver Mattress Co., LLC, Denver, CO (US)

( * ) Notice: Subject to any disclaimer, the term of this patent is extended or adjusted under 35 U.S.C. 154(b) by 0 days.

(21) Appl. No.: 16/046,699

(22) Filed: Jul. 26, 2018

(65) Prior Publication Data

US 2019/0053633 A1 Feb. 21, 2019

Related U.S. Application Data

(63) Continuation-in-part of application No. 15/729,722, filed on Oct. 11, 2017, now abandoned, which is a continuation of application No. 13/666,253, filed on Nov. 1, 2012, now abandoned.

(60) Provisional application No. 61/554,413, filed on Nov. 1, 2011.

(51) Int. Cl.

| | |
|---|---|
| ***A47C 27/15*** | (2006.01) |
| ***B68G 3/00*** | (2006.01) |
| ***A47C 31/10*** | (2006.01) |
| ***A47C 21/04*** | (2006.01) |
| ***A47C 27/14*** | (2006.01) |

(52) U.S. Cl.

CPC ..... *A47C 27/15* (2013.01); *A47C 21/04* (2013.01); *A47C 21/046* (2013.01); *A47C 27/148* (2013.01); *A47C 31/105* (2013.01); *B68G 3/00* (2013.01)

(58) Field of Classification Search

CPC ..... A47C 27/15
USPC ..... 5/740, 655.9, 953
See application file for complete search history.

(56) References Cited

U.S. PATENT DOCUMENTS 2,147,362 A 2/1939 Bloomberg
2,722,268 A 11/1955 Green et al.
(Continued)

OTHER PUBLICATIONS

U.S. Appl. No. 13/666,253 received a Non-Final Office Action dated Oct. 23, 2013, 14 pages.
(Continued)

*Primary Examiner* — Fredrick C Conley
(74) *Attorney, Agent, or Firm* — Kilpatrick Townsend & Stockton LLP

(57) ABSTRACT

A foam core mattress including a cushion layer having a foam with an IFD of between about 6 to about 18 and a density of between about 1.5 lb./ft$^3$ to about 4 lb./ft$^3$. The mattress includes a core that is coupled with a bottom surface of the cushion layer. The core includes a matrix of rebond foam pieces that includes at least 5% foam pieces having volumes of less than about 0.5 in$^3$, at least 40% foam pieces having volumes of between about 0.5 and 2.0 in$^3$, and at least 20% foam pieces having volumes of greater than 2.0 in$^3$, wherein the core has an IFD of between about 21 and 36. The mattress includes a base layer coupled with a bottom surface of the core. The base layer has an IFD of between about 28 to about 70 and a density of between 1.5 lb./ft$^3$to about 2 lb./ft$^3$.

17 Claims, 13 Drawing Sheets

(56) References Cited

U.S. PATENT DOCUMENTS

| | | | | |
|---|---|---|---|---|
| 2,878,494 | A * | 3/1959 | Healy | A47C 27/144 5/722 |
| 3,900,648 | A | 8/1975 | Smith | |
| 3,939,508 | A * | 2/1976 | Hall | A47C 27/15 5/727 |
| 4,683,246 | A | 7/1987 | Davis et al. | |
| 4,801,493 | A | 1/1989 | Ferziger et al. | |
| 4,862,539 | A | 9/1989 | Bokich | |
| 5,096,623 | A | 3/1992 | Ward et al. | |
| 5,114,981 | A | 5/1992 | Ward et al. | |
| 5,175,194 | A | 12/1992 | Ward et al. | |
| 5,290,818 | A | 3/1994 | Nafziger et al. | |
| 5,312,888 | A | 5/1994 | Nafziger et al. | |
| 5,397,620 | A | 3/1995 | Hord, III | |
| 5,745,940 | A | 5/1998 | Roberts et al. | |
| 5,817,703 | A | 10/1998 | Blair et al. | |
| 5,880,165 | A | 3/1999 | Triolo et al. | |
| 6,136,870 | A | 10/2000 | Triolo et al. | |
| 6,159,574 | A | 12/2000 | Landvik et al. | |
| 6,223,371 | B1 | 5/2001 | Antinori et al. | |
| 6,290,800 | B1 | 9/2001 | Antinori et al. | |
| 6,378,150 | B1 | 4/2002 | Minegishi et al. | |
| 6,447,874 | B2 * | 9/2002 | Antinori | B32B 5/22 112/420 |
| 6,541,094 | B1 | 4/2003 | Landvik et al. | |
| 6,574,814 | B2 | 6/2003 | Collard et al. | |
| 6,623,847 | B2 | 9/2003 | Yates | |
| 6,643,876 | B2 | 11/2003 | Visser et al. | |
| 6,656,856 | B1 | 12/2003 | Rucker | |
| 6,757,956 | B2 | 7/2004 | Koch et al. | |
| 6,782,575 | B1 | 8/2004 | Robinson | |
| 6,895,620 | B1 | 5/2005 | Rensink | |
| 6,928,678 | B1 | 8/2005 | Chang | |
| 6,952,850 | B2 | 10/2005 | Visser et al. | |
| 6,997,070 | B2 | 2/2006 | Killingbeck | |
| 7,124,652 | B2 | 10/2006 | Killingbeck | |
| 7,255,917 | B2 | 8/2007 | Rochlin et al. | |
| 7,284,494 | B2 | 10/2007 | Rensink | |
| 7,461,424 | B2 | 12/2008 | Lindell | |
| 7,617,556 | B2 | 11/2009 | Rensink | |
| 7,617,788 | B2 | 11/2009 | Rensink | |
| 7,707,670 | B2 | 5/2010 | Fogg | |
| 8,141,957 | B2 | 3/2012 | McClung et al. | |
| 2003/0093864 | A1 | 5/2003 | Visser et al. | |
| 2003/0154589 | A1 | 8/2003 | Koch et al. | |
| 2004/0099070 | A1 | 5/2004 | Killingbeck | |
| 2004/0148706 | A1 | 8/2004 | Visser et al. | |
| 2005/0026528 | A1 | 2/2005 | Forsten et al. | |
| 2005/0076446 | A1 | 4/2005 | Fogg | |
| 2005/0084667 | A1 | 4/2005 | Landvik et al. | |
| 2005/0095936 | A1 | 5/2005 | Jones et al. | |
| 2005/0097676 | A1 | 5/2005 | Rensink | |
| 2005/0115001 | A1 | 6/2005 | Horst | |
| 2005/0166330 | A1 | 8/2005 | Williams | |
| 2006/0059631 | A1 | 3/2006 | Rensink | |
| 2006/0081075 | A1 | 4/2006 | Killingbeck | |
| 2006/0096032 | A1 | 5/2006 | Rensink | |
| 2006/0106124 | A1 | 5/2006 | Fink et al. | |
| 2006/0272098 | A1 | 12/2006 | Hochschild | |
| 2006/0288490 | A1 | 12/2006 | Mikkelsen et al. | |
| 2006/0288491 | A1 | 12/2006 | Mikkelsen et al. | |
| 2008/0060137 | A1 | 3/2008 | Wenstrup et al. | |
| 2008/0092302 | A1 | 4/2008 | Rensink | |
| 2008/0263774 | A1 | 10/2008 | Lee | |
| 2009/0029147 | A1 | 1/2009 | Tang et al. | |
| 2009/0149101 | A1 | 6/2009 | Sytz | |
| 2010/0115704 | A1 | 5/2010 | Rensink | |
| 2010/0186172 | A1 | 7/2010 | Dennis | |
| 2010/0223734 | A1 | 9/2010 | Oh | |
| 2011/0047708 | A1 | 3/2011 | Rensink et al. | |
| 2011/0067183 | A1 | 3/2011 | Hawkins | |
| 2011/0067215 | A1 | 3/2011 | Rensink | |
| 2011/0173757 | A1 | 7/2011 | Rensink et al. | |
| 2011/0185500 | A1 * | 8/2011 | Sanders | A47C 27/007 5/502 |
| 2011/0252572 | A1 | 10/2011 | Morrison | |
| 2012/0258643 | A1 | 10/2012 | Ruf et al. | |
| 2013/0111672 | A1 * | 5/2013 | Rensink | A47C 27/15 5/698 |
| 2015/0182032 | A1 * | 7/2015 | Jensen | G09F 3/00 5/699 |

OTHER PUBLICATIONS

U.S. Appl. No. 13/666,253 received a Final Office Action dated Jan. 15, 2014, 10 pages.

U.S. Appl. No. 13/666,253 received an Advisory Action dated Mar. 13, 2014, 6 pages.

U.S. Appl. No. 13/666,253 received a Non-Final Office Action dated May 7, 2014, 8 pages.

U.S. Appl. No. 13/666,253 received a Final Office Action dated Sep. 24, 2014, 12 pages.

U.S. Appl. No. 13/666,253 received an Advisory Action dated Dec. 8, 2014, 5 pages.

U.S. Appl. No. 13/666,253 received a Non-Final Office Action dated Jun. 24, 2015, 12 pages.

U.S. Appl. No. 15/729,722 received a Non-Final Office Action dated Mar. 26, 2018, 14 pages.

* cited by examiner

UPCYCLED MATTRESS NUCLEUS OF ESSENTIAL FOAM ELEMENTS

CROSS-REFERENCES TO RELATED APPLICATIONS

This application is a Continuation-in-Part of U.S. patent application Ser. No. 15/729,722, filed Oct. 11, 2017, which is a continuation of U.S. patent application Ser. No. 13/666,253, filed Nov. 1, 2012, which claims priority to U.S. Provisional Application No. 61/554,413, filed Nov. 1, 2011, the disclosures of which are incorporated by reference herein in their entireties.

BACKGROUND OF THE INVENTION

Spring mattresses have been in use for over 100 years. Existing spring mattresses use a variety of spring types to form their inner core. Perhaps the most common is the traditional wire spring assembly having a set of interconnected wire spring coils. As manufacturing processes have improved, it is becoming more common to use other types of cores, including cores made of a single material, such as a core constructed from a solid piece of latex or polyurethane.

BRIEF SUMMARY OF THE INVENTION

The mattresses described herein may be useful as mattresses for conventional beds, but they may also be useful for mattresses used with a sleeper sofa, camper beds, yacht beds, cruise-ships beds, play mats, gym mats, camping pads, nap pads, or any other potential use where a core with a padded surface may be desirable. The term "mattress" as used herein is intended to encompass these and other appropriate uses. The mattresses described herein include a cushion layer, core, and base layer. The core is constructed from a matrix of small foam pieces that are bonded to one another to form the core. The core, cushion layer, and base layer are designed to have a particular set of physical parameters (density, thickness, indentation force deflection (IFD), etc.) to achieve a proper balance between comfort and spinal support.

In one embodiment, a foam core mattress is provided. The mattress may include a cushion layer having a foam having an IFD of between about 6 to about 18 and a density of between about 1.5 lb./ft$^3$ to about 4 lb./ft$^3$. The mattress may also include a core that is coupled with a bottom surface of the cushion layer. The core may include a matrix of rebond foam pieces that includes at least 5% foam pieces having volumes of less than about 0.5 in$^3$, at least 40% foam pieces having volumes of between about 0.5 and 2.0 in$^3$, and at least 20% foam pieces having volumes of greater than 2.0 in$^3$. The core may have an IFD of between about 21 and 36. The mattress may further include a base layer coupled with a bottom surface of the core. The base layer may have an IFD of between about 28 to about 70 and a density of between 1.5 lb./ft$^3$ to about 2 lb./ft$^3$.

In another embodiment, a foam core mattress may include a cushion layer comprising a foam having an IFD of between about 6 to about 18 and a density of between about 1.5 lb./ft$^3$ to about 4 lb./ft$^3$. The mattress may also include a core that is coupled with a bottom surface of the cushion layer. The core may include a matrix of rebond foam pieces that includes at least 35% foam pieces having densities between about 1.5 and 2.2 lb./ft$^3$, at least 40% foam pieces having densities between about 2.2 and 3.0 lb./ft$^3$, and at least 2% foam pieces having densities of less than about 1.5 lb./ft$^3$. The core may have an IFD of between about 21 and 36. The mattress may further include a base layer coupled with a bottom surface of the core. The base layer may have an IFD of between about 28 to about 70 and a density of between 1.5 lb./ft$^3$ to about 2 lb./ft$^3$.

In another embodiment, a method of constructing a foam core mattress is provided. The method may include combining a plurality of rebond foam pieces with a binder. The plurality of rebond foam pieces may include at least 5% foam pieces having volumes of less than about 0.5 in$^3$, at least 40% foam pieces having volumes of between about 0.5 and 2.0 in$^3$, and at least 20% foam pieces having volumes of greater than 2.0 in$^3$. The method may also include compressing the combined plurality of rebond foam pieces and the binder in a mold to form a loaf having an IFD of between about 21 and 36 and a density of between about 3.0 and 4.0 lb./ft$^3$. The method may further include applying heat to the loaf to cure the binder, cutting the loaf to form a core, and assembling the foam core mattress by attaching a base layer to a bottom surface of the core and attaching a cushion layer to a top surface of the core.

BRIEF DESCRIPTION OF THE DRAWINGS

A further understanding of the nature and advantages of various embodiments may be realized by reference to the following figures.

DETAILED DESCRIPTION OF THE INVENTION

Figure 1A:
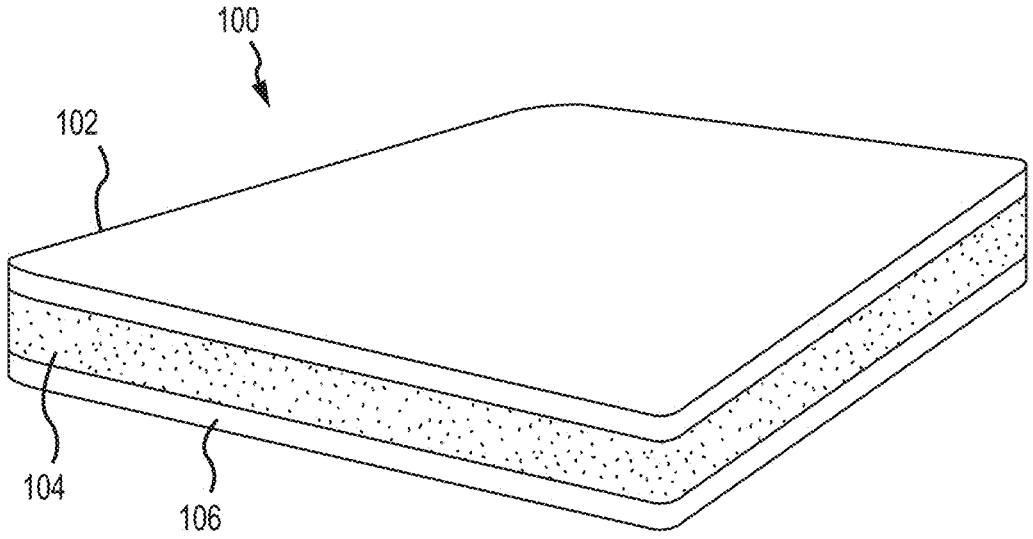
FIG. 1A depicts an isometric view of a foam core mattress according to embodiments.

Embodiments of the present invention are directed to multi-layer, foam core mattresses that are designed to achieve two important results: 1) proper spinal support and 2) sufficient comfort levels, while also providing a mattress that may be easily packaged and shipped for delivery. These results are achieved by the inventive mattresses described herein that include at least a cushion layer, core, and base layer that have carefully designed physical parameters.

As discussed above, one important feature of a mattress is the ability to align the user's spine when the user is in a prone position on the mattress. Improper spinal alignment may lead to inadequate rest and recuperation, which in turn leads to muscle aches, spasm, and fatigue. More severe effects of improper spinal alignment when sleeping include excessive stress on tissues and joints that may result in accelerated degenerative disc disease, ligamentous injury, and degenerative joint disease of the spine.

Of course, this could be accomplished by constructing the mattress components to be extremely firm, such as by using a board. However, this conflicts with a second critical feature of a mattress, which is the ability to provide comfort. More specifically, if the mattress is not soft enough, it will cut off a user's circulation, thereby leading to a restless sleep. Hence, when constructing a mattress, careful attention must be paid to providing proper spinal alignment (so the user will not suffer from a backache) with sufficient cushion so that blood flow is not cut off to the body's extremities. For example, if a user's hips sink into the mattress, the user will tend to get a backache. This can be remedied by providing an extremely stiff mattress. However, this will inevitably lead to the body's extremities losing blood flow, thereby causing the extremities to "fall asleep".

To ensure a proper balance of comfort and support, it is critical to construct a mattress having certain physical parameters. This is especially true in multi-layer mattresses, where the parameters of the various layers are interrelated and must be carefully designed to arrive at a mattress having the desired spinal support and comfort characteristics. These parameters include the thickness, density, and indentation force deflection (IFD) of each of the mattress layers. The IFD of a mattress refers to the hardness or softness of the foam. For example, the higher the IFD, the firmer the foam. IFD is defined as the amount of force, in pounds, required to indent a fifty square inch, round indentor foot into a predefined foam specimen a certain percentage of the specimen's total thickness. IFD is specified as a number of pounds at a specific deflection percentage on a specific height foam sample, e.g., 25 pounds applied to 50 square inches at a 25% deflection on a four inch thick piece.

An adjustment to one of these critical parameter cannot be done without considering the ramifications on other aspects of the mattress. As just one example, an adjustment to the IFD of one layer (such as to change a comfort level of the mattress) must be considered in light of its effects on the spinal support characteristics of the mattress. Embodiments of the present invention relate to foam-core mattresses that include three primary layers, a top cushion layer, a core, and bottom base layer. The physical parameters of each layer are carefully designed to achieve a desired level of support and comfort.

Embodiments of the invention provide a relatively dense core, significantly more dense than traditional polyurethane cores. This increased density provides a stronger and more durable core while providing a more comfortable feel. The mattresses described herein utilize a core made up of a matrix of foam pieces or elements that are bonded together. This matrix of foam pieces is also firm and is constructed of a variety of small urethane or other foam pieces (typically new, unused re-purposed, upcycled, and/or otherwise reclaimed foam pieces). For example, the foam pieces may include new foam that cannot be cut into other pieces of the desired size or sections of foam that are not the desired density for other purposes, allowing the foam to be re-purposed in a new fashion) that are joined together using an adhesive (binder, separate adhesive, and/or other bonding agent), heat and steam that tend to increase the density. One particularly useful method for constructing cores using such a process is described hereinafter. Not only is this friendly to the environment, it also significantly reduces the cost of the mattress.

Further, the core may be constructed to be relatively dense, has an IFD in the range from about 28 to about 65 and is relatively inexpensive. Other types of materials that may be used include, but are not limited to, polystyrene materials, polyurethane, densified fibers and the like. A wide variety of optional layers may be coupled to the top and/or bottom surface of the core. For example, another dense foam material may be coupled to the bottom of the core. A variety of layers may be placed on top of the core, including additional padding layers, ticking, foam, a quilted layer, or the like.

Figure 1B:
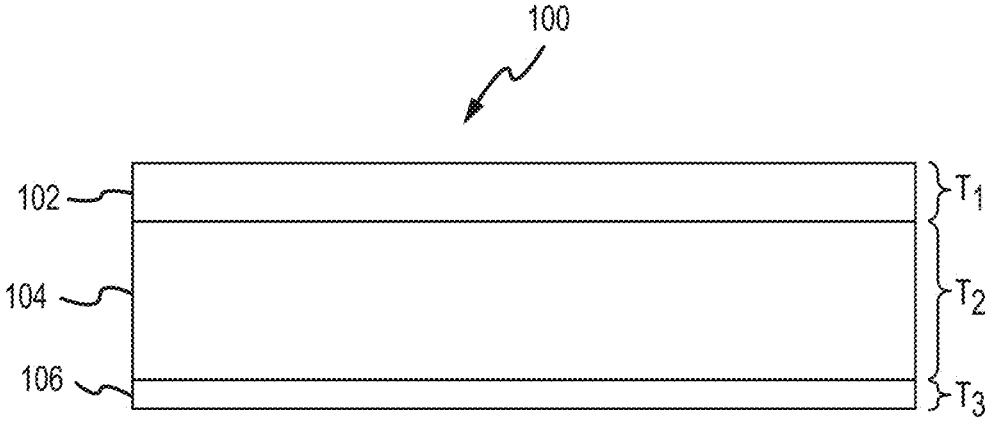
FIG. 1B depicts a front view of the foam core mattress of FIG. 1.

Turning now to FIG. 1A, one embodiment of a mattress 100 is shown. Mattress 100 includes a top cushion layer 102 that provides additional comfort to the mattress 100. The cushion layer 102 may be formed from latex, air insulated viscofoam or other airfoam, gelfoam, and/or other foam material with enhanced ventilating properties so that it breathes more and keeps the sleeper cooler. In some embodiments, the cushion layer 102 may be hole punched to generate additional holes within the cushion material to increase the breathability of the cushion layer 102. The cushion layer 102 may be formed as a combination of one or more comfort layers, with multiple layers being formed of the same or different materials. In some embodiments, three or more layers may be included in the cushion layer 102. In some of these embodiments, two or more of the layers may be the same material and/or thickness. For example, alternating layers of different materials may include two layers of the same material with a different layer sandwiched in between. Any combination of number of layers, thickness of layers, and/or materials may be selected that achieve the overall physical parameters (thickness, IFD, density) specified herein. The density of this cushion layer 102 may be in the range from about 1.5 pounds per cubic foot to about 4 pounds per cubic foot. In a particular embodiment, the density may range from about 2 pounds per cubic foot to about 4 pounds per cubic foot, and may specifically be about 3 pounds per cubic foot or about 3.5 pounds per cubic foot. As shown in FIG. 1B, the thickness $T_1$ of the cushion layer may be about 1 inch to about 4 inches, more specifically from about 1 inch to about 4 inches, and more specifically, from about 2 inches to about 4 inches, and even more particularly, about 3.5 inches. The cushion layer may have an IFD rating of about 6 to about 18.

In some embodiments, one or both sides of the cushion layer 102 may be surface modified using various machining processes. Examples of surface modifications include convoluted, contoured, quilting, and the like. Other materials that may be used include fiber padding materials. Further, mattresses 100 of the invention may include a layer of ticking that is a piece of fabric or quilting that envelopes the mattress as is known in the art. The ticking may include essentially any type of fabric or covering and may be sewn to form it around the core and other padding layers.

The cushion layer 102 (or in some embodiments, multiple cushion layers) is positioned atop a core 104. Core 104 that is constructed of a matrix of rebond foam pieces that are bonded together. For example, polystyrene materials, polyurethane, and/or other foam pieces may be used. This matrix of foam pieces is also firm and is constructed of a variety of small urethane or other foam pieces (typically re-purposed foam pieces, for example new foam that cannot be cut into other pieces of the desired size or sections of foam that are not the desired density for other purposes, allowing the foam to be upcycled in a new fashion) that are joined together using an adhesive, heat and steam that tend to increase the density. The core 104 may be constructed from a mix of different sizes and shapes of foam pieces. For example, the core 104 may be formed from a mixture of a first subset of foam pieces having volumes of less than about 0.5 $in^3$, a second subset of foam pieces having volumes of between about 0.5 and 2.0 $in^3$, and a third subset of foam pieces having volumes of greater than about 2.0 $in^3$. In some embodiments, the core 104 includes between about 5% and 20% (more preferably between about 10% and 15%) by total number of pieces of the first subset, between about 40% and 50% of the second subset (more preferably between about 45% and 48%), and between about 30% and 55% of the third subset (more preferably between about 37% and 55%). In a particular embodiment, the core 104 may include at least 5% foam pieces having volumes of less than about 0.5 $in^3$, at least 40% foam pieces having volumes of between about 0.5 and 2.0 $in^3$, and at least 20% foam pieces having volumes of greater than 2.0 $in^3$.

The use of foam pieces from the various subsets of sizes is critical in providing a core 104 that is both supportive and durable, as the smaller pieces of foam are able to fill in the voids between larger pieces to provide a more consistent foam that does not have any particular weak spots that may degrade earlier to damage the core 104. Additionally, the use of large pieces provides a greater level of spinal support. Thus, it is imperative to use a mixture of foam pieces from each subset of piece sizes as disclosed herein.

The volumes of the various subsets may be achieved by any combination of dimensions for each of the foam pieces. As just one example, the first subset may include foam pieces having dimensions of less than about 1.0 in×1.0 in×0.5 in, foam pieces having dimensions of less than about 0.5 in×0.5 in×2.0 in, foam pieces having dimensions of less than about 0.25 in×0.5 in×4.0 in, and/or any other combination of dimensions that results in the total volume of the respective foam piece being less that about 0.5 $in^3$. The foam pieces of each category may include regularly shaped pieces (spheres, cubes, rectangular prisms, etc.), irregularly shaped pieces (such as those pieces torn, sheered, and/or otherwise from a larger piece of foam without the use of a precision cutting implement), and/or combinations thereof. In the case of irregularly shaped pieces, rather than using a set length, width, thickness, a weighted average of each of these dimensions may be used to determine the standard length×width×thickness dimensions.

The core 104 may be constructed from pieces of foam having a variety of different densities. For example, the core 104 may be formed from a mixture of a fourth subset of foam pieces having densities of less than about 1.5 lb./$ft.^3$, a fifth subset of foam pieces having densities of between about 1.5 and 2.2 lb./$ft^3$, and a sixth subset of foam pieces having densities of between about 2.2 and 3.0 lb./$ft.^3$ (although some pieces with densities over 3.0 lb./$ft.^3$ may be used in some embodiments). In some embodiments, the core 104 includes between about 2% and 10% (more preferably between about 4% and 8%) (by weight? or total pieces?) of the fourth subset, between about 35% and 55% of the fifth subset (more preferably between about 40% and 50%), and between about 35% and 63% of the sixth subset (more preferably between about 42% and 56%). In a particular embodiment, the core 104 may include at least 35% foam pieces having densities between about 1.5 and 2.2 lb./$ft^3$, at least 40% foam pieces having densities between about 2.2 and 3.0 lb./$ft^3$, and at least 2% foam pieces having densities of less than about 1.5 lb./$ft.^3$.

The core 104 may be constructed from pieces of foam having a variety of different IFDs. For example, the core 104 may be formed from a mixture of a seventh subset of foam pieces having IFDs of between about 15 and 20, an eighth subset of foam pieces having IFDs of between about 20 and 30, and a ninth subset of foam pieces having IFDs of between about 30 and 40 (although some pieces with IFDs over 40 may be used in some embodiments). In some embodiments, the core 104 includes between about 15% and 30% (more preferably between about 20% and 25%) (by weight? or total pieces?) of the seventh subset, between about 25% and 40% of the eighth subset (more preferably between about 30% and 35%), and between about 30% and 60% of the ninth subset (more preferably between about 40% and 50%). In a particular embodiment, the core 104 may include at least 15% foam pieces having IFDs between about 15 and 20, at least 25% foam pieces having IFDs between about 20 and 30, and at least 40% foam pieces having densities of between about 30 and 40.

Various combinations of sizes, shapes, densities, IFDs may be used in each category. Subsets of the different parameters may overlap. In other words, any of the first three subsets may have some overlap with multiple categories of subsets 4-6 and/or 7-9. Any of the 4-6 subsets may have some overlap with multiple categories of subsets 1-3 and/or 7-9. Any of the 7-9 subsets may have some overlap with multiple categories of subsets 1-3 and/or 4-6. As just one example, the first subset of foam pieces having volumes of less than about 0.5 $in^3$ may include foam pieces having densities of from one or all of the subsets such that the subset of smallest foam pieces may include the least dense foams, most dense foams, and/or any foams with densities in the middle. In other words, the smallest foam pieces are not necessarily the least dense pieces or the most dense pieces. Various combinations of densities and/or IFD foams may be used in foam pieces of any size.

Once formed, core 104 typically has a thickness $T_2$ in the range from about 3 inches to about 8 inches. In a particular embodiment, the core 104 thickness may range from about 3 inches to about 5 inches, and may specifically be about 4.5 inches. In an alternate embodiment, the core thickness may range from about 4 inches to about 6 inches, and may specifically be about 5.5 inches. In a further embodiment, the core thickness may range from about 6 inches to about 8 inches, and may specifically be about 7.5 inches. The core should be thick enough to provide appropriate support for sleeping and/or otherwise supporting one or more people, but should be thin enough that the mattress does not become unwieldy to transport or so large that sheets are difficult to secure in place about the mattress.

The core 104 may have a density of between about 3.0 and 4 lb./ft$^3$, and more preferably between about 3.3 and 3.6 lb./ft$^3$. The density may be varied based upon the size and number of foam pieces used, as well as the type of binder used. The core 104 is relatively dense, significantly more dense than traditional polyurethane cores. This increased density provides a stronger and more durable core 104 while providing a more comfortable feet. The core 104 may have an IFD of between about 21 and 36, and more preferably between about 28 and 34, with an IFD of around 32 being common. Such a core 104 is relatively firm and helps to provide proper spinal alignment. The IFD values interrelate with the density and thickness of each of the layers to provide the desired spinal support and comfort characteristics of the mattress 100. Therefore, any combination of these values of the disclosed physical parameters of the core 104, in conjunction with the disclosed cushion layer 102, are critical in manufacturing a mattress 100 having the proper balance of spinal support and comfort characteristics. For example, the cushion layer 102 has a density in the range from about 1.5 pounds per cubic foot to about 4 pounds per cubic foot, a thickness in the range from 1 inches to about 4 inches and an IFD of about 6 to about 18 to provide proper cushioning while the core 104 provides proper spinal alignment.

As referenced above, the various foam pieces are mixed with a binder to form the matrix of the core 104. The binder may be a mixture of at least one polyol and at least one aromatic isocyanate (such as, but not limited to toluene diisocyanate (TDI) and/or methylene diphenyl diisocyanate (MDI)), which may form a polyurethane binder to fill in voids between the individual foam pieces and create a more dense core 104. During the mixing of the polyol(s) and aromatic isocyante(s) the chemical reaction may generate heat. Additional heat may be applied to the mixture of the binder and the foam pieces to set the binder. In some embodiments, the polyol(s) may form between about 40% and 60% of the binder, with the aromatic isocyanate(s) making up the remainder of the binder. The matrix of foam pieces of the core 104 may be formed of between about 80% and 98% by weight of foam pieces and between about 2% and 20% of the binder. Such ranges enable the production of the core 104 having the necessary core density and IFD ranges. Specifically, such binder ranges allow for the use of lower density foam pieces in the construction of a core 104 having a higher density than any of the individual foam pieces, as the binder contributes to the core's overall density.

Coupled to a bottom surface of the core 104 may be a base layer 106. The two may be coupled together by one or more glues, binders, other adhesives or bonding agents, and/or combinations thereof. Base layer 106 may be a thin piece (or in some embodiments, multiple layers) of foam that is less dense than core 104. The base layer 106 of the mattress 100 is critical in that it is relatively thin, having a thickness $T_3$ in the range from about 0.75 inch to about 1.5 inches. In a particular embodiment, the base layer thickness may range from about 0.75 to about 1 inches, and may specifically be about one inch. The density may be in the range from about 1.5 pound per cubic foot to about 2 pounds per cubic foot, with an IFD of about 24 to about 45. These parameters are critical in ensuring that the base layer 106 can be constructed to be relatively light and relatively inexpensive, while also being able to hold the core 104 in place when the mattress 100 is compressed and then rolled prior to shipping. In particular, base layer 106 may serve to help hold together the foam pieces in the matrix of the core 104, thus increasing the lift of the mattress 100. For example, for mattresses 100 that are produced overseas there is a need to ship the mattresses 100 to the United States. To do this, the core 104 and cushion layer 102 are significantly compressed and then rolled into a generally cylindrical roll. Because the core 104 is constructed of a matrix of foam pieces that are adhesively bonded together, when the core 104 is compressed and then rolled the foam pieces tend to break apart. By coupling a relatively thin and light weight base layer 106 to the core 104, the core 104 can be compression rolled without the foam pieces coming apart. At the same time, the weight of the mattress 100 is minimized and the construction costs are reduced.

Figure 2A:
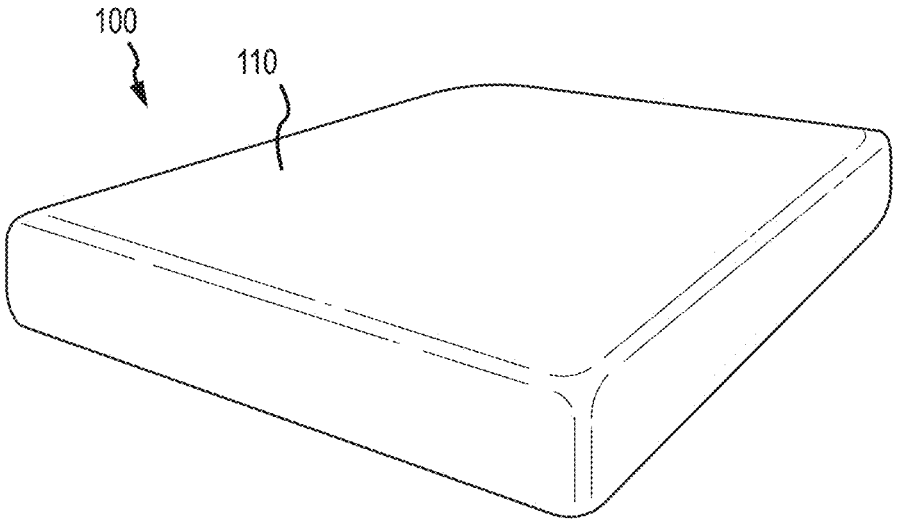
FIG. 2A depicts the mattress of FIG. 1 having a mattress cover.
Figure 2B:
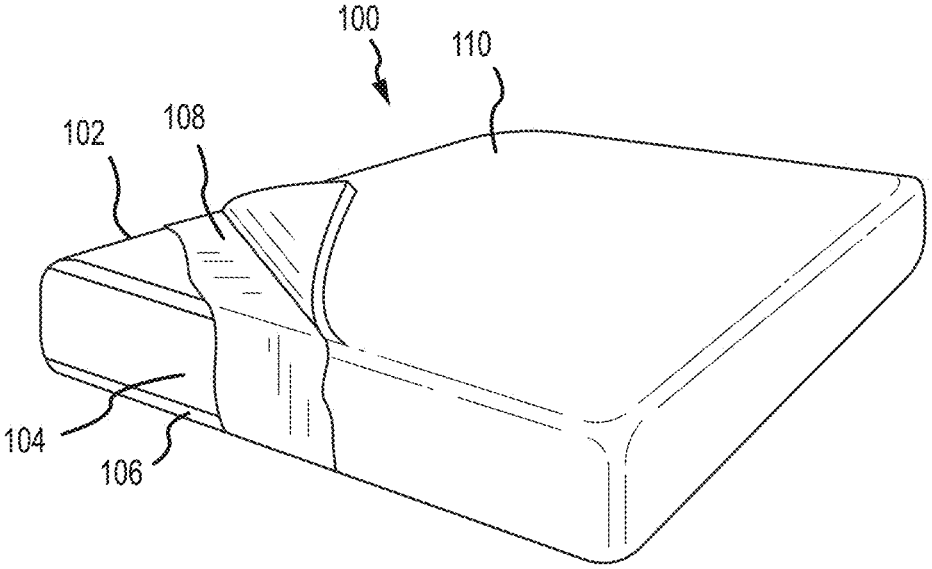
FIG. 2B depicts the mattress of FIG. 1 with a mattress cover peeled back.

In some embodiments, a wide variety of optional layers may be coupled to the top and/or bottom surface of the core 104. For example, another dense foam material may be coupled to the bottom of the core 104. A variety of layers may be placed on top of the core 104, including additional padding layers, ticking, foam, a quilted layer, or the like. As just one example, FIGS. 2A and 2B depict mattress 100 having a cover ticking 108 that envelops the mattress 100. Ticking 108 includes a fabric that is secured about the various layers. The ticking 108 may be placed around the mattress 100 and secured using one or more fastening mechanisms. For example, the ticking 108 may be closed around the mattress 100 using zippers, buttons, clasps, and/or other mechanical fasteners.

A mattress cover 110 may additionally, or alternatively, be included to cover all or part of the mattress 100. In embodiments in which a ticking 108 is also included, the mattress cover 110 may be configured to envelop the ticking 108 as well. The mattress cover 110 may be placed around the mattress 100 and secured using one or more fastening mechanisms. For example, the mattress cover 110 may be closed around the mattress 100 using zippers, buttons, clasps, and/or other mechanical fasteners.

In some embodiments, a top surface of the cushion layer 102, all or part of an FR sock, all or part of ticking 108, all or part of a mattress cover 110, and/or other components of mattress 100 may include a phase change material (PCM). For example, one or more phase-change materials, often in the form of microencapsulated gels and/or polymer chain links (such as polyolefins with melting points within typical sleep temperature ranges) and/or PCMs that are incorporated within the bedding foams themselves, may be included on mattress components that form all or part of a sleeping surface of the mattress. These PCMs may be selected and balanced to narrow the effective temperature range to a comfort zone for sleeping. For example, the PCMs may be designed to absorb body heat that you release during the night, then as a user's body temperature lowers, the PCM will release heat to keep the user at a designated temperature (or within a desired temperature range) to ensure the user stays comfortable throughout sleep.

In some embodiments, a flame or fire retardant sock (referred to as an FR sock) may be provided to enclose the completed mattress 100. Per regulations, this provides a covering for the mattress 100 that meets an open flame standard. Alternatively, a flame retardant or resistant fiber layer may be provided below quilting if desired.

In some embodiments, a top surface of the cushion layer 102, all or part of an FR sock, all or part of ticking 108, all or part of a mattress cover 110, and/or other components of mattress 100 may include a phase change material (PCM). For example, one or more phase-change materials, often in the form of microencapsulated gels and/or polymer chain links (such as polyolefins with melting points within typical sleep temperature ranges) and/or PCMs that are incorporated within the bedding foams themselves, may be included on mattress components that form all or part of a sleeping surface of the mattress. These PCMs may be selected and balanced to narrow the effective temperature range to a comfort zone for sleeping. For example, the PCMs may be designed to absorb body heat that you release during the night, then as a user's body temperature lowers, the PCM will release heat to keep the user at a designated temperature (or within a desired temperature range) to ensure the user stays comfortable throughout sleep. During the quiet stage of the sleep cycle, a person's heart rate and breathing slow down and the auto nervous system takes over. During this phase, the body must cool down between about 1-2° F. in order to not interrupt the sleep cycle. The inclusion of these PCM materials (and the use of other techniques described herein to enhance the breathability of the mattress) helps ensure a cooler sleep surface that enables the body to properly cool down, thereby enhancing the level of sleep for a user.

Figure 3:
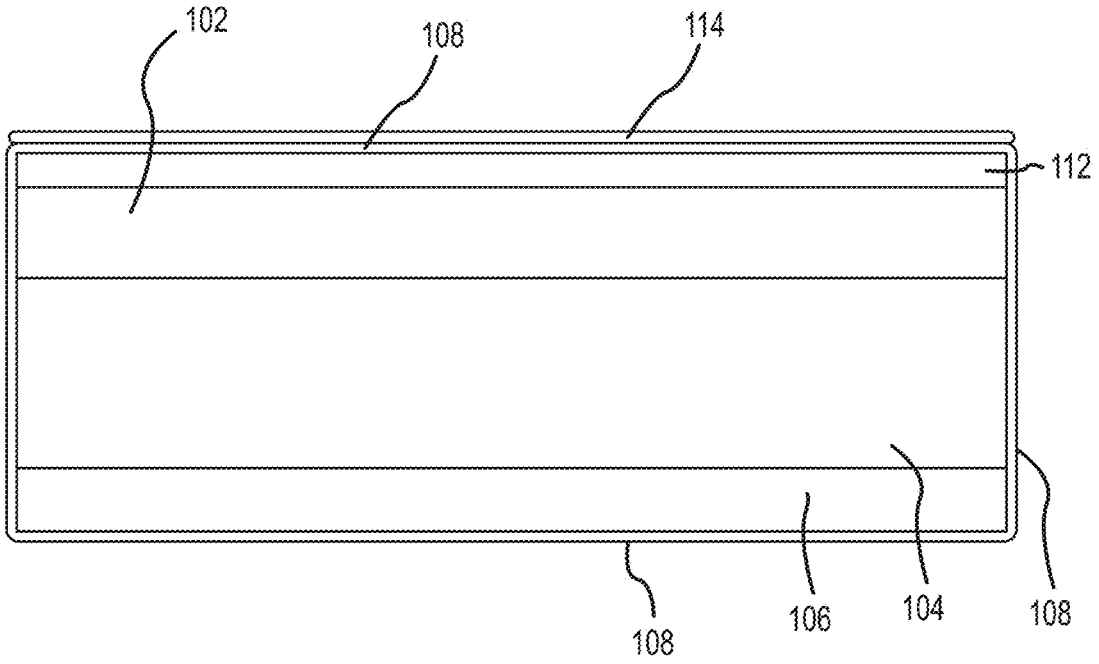
FIG. 3 depicts an alternative mattress construction according to embodiments.

As shown in FIG. 3, various other layers may be provided on mattress 100 to change the look and feet of the mattress. These layers could be included beneath the ticking 108, such as with layer 112, or above ticking 108, such as in the case of an independent topper 114. These additional layers may be surface modified, such as convoluted. Examples of materials that may be used for the additional layers include latex, gel materials, fibrous spacer materials, that may optionally include a gel material, and the like. Also, various backing materials and fire resistant layers or materials may be used as well.

Figure 4:
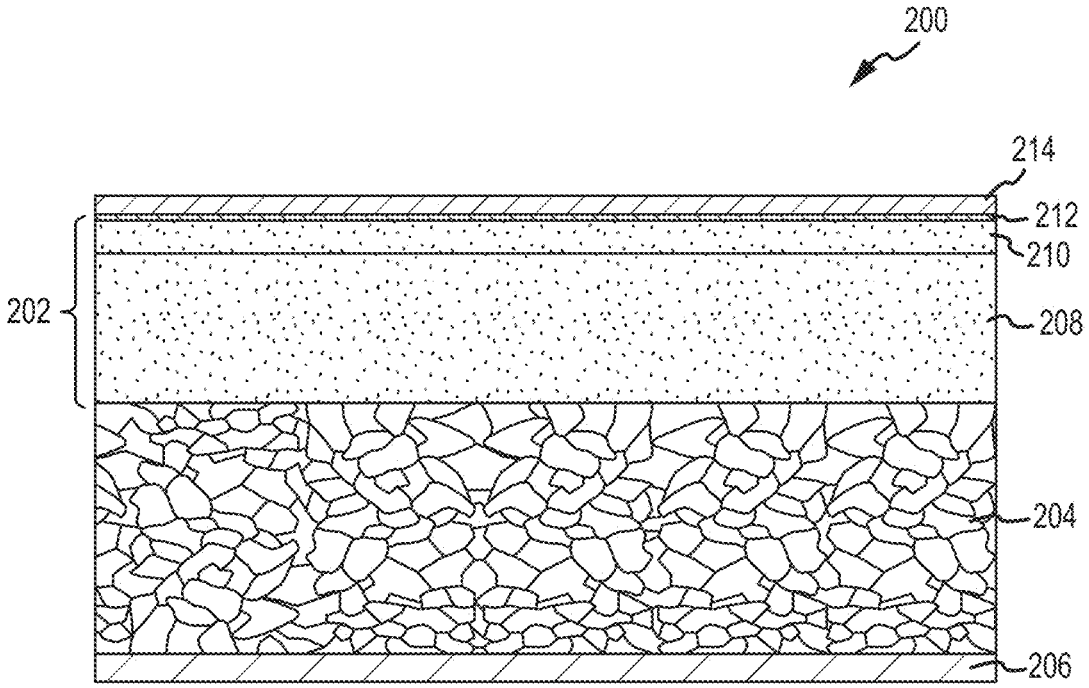
FIG. 4 depicts an alternative mattress construction according to embodiments.

As shown in FIG. 4, in a particular embodiment a mattress 200 having a cushion layer 202 formed of two layers. For example, a first layer 208 may be a visco-elastic memory foam and a second layer 210 may be a second visco-elastic memory foam layer or a gel visco-elastic memory foam layer. The first layer 208 of visco-elastic memory foam may be about 2 to about 2.5 inches thick and may have a density of about 3 to about 3.5 pounds per cubic foot. The second layer 210 of visco-elastic memory foam layer or gel visco-elastic memory foam may be about 1 to about 1.5 inches thick. Providing two layers in the cushion layer 202 can add additional comfort to the mattress 200. Such a combination of layers allows the two-layer cushion layer 202 to exhibit slightly different comfort characteristics than the cushion layer 102 of mattress 100, while the two layers together exhibit overall density and thickness parameters that are in line with those described in relation to the single-layer cushion layer 102 of mattress 100. The two-layer cushion layer 202 may be positioned atop a core 204 and base layer 206, which may be designed to the same specifications as those described in relation to mattress 100.

Additionally, while not shown, it will be appreciated that mattress 200 may include additional layers, such as a ticking layer 212, mattress cover, FR sock, mattress topper 214, and/or other additional layers. Additionally, one or more of the layers of the mattress 200 may include a PCM material to help maintain a consistent and comfortable sleep temperature.

Figure 5:
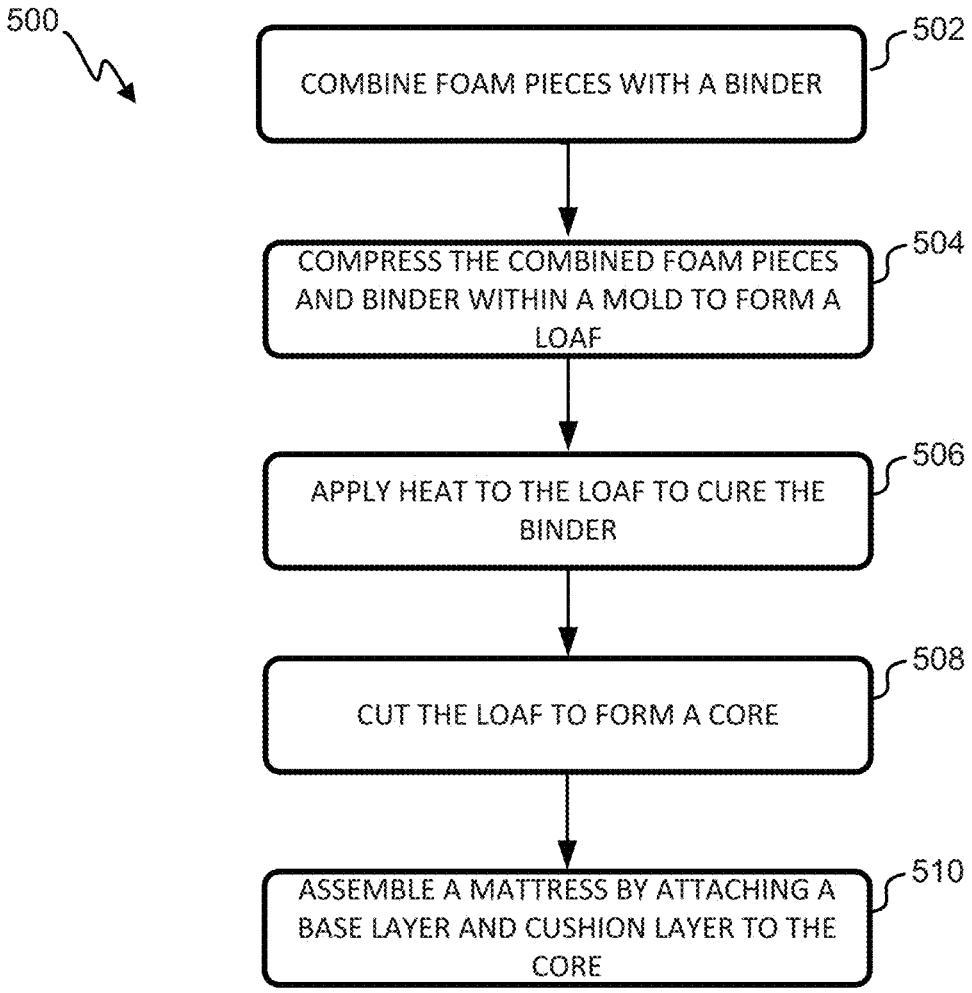
FIG. 5 is a flowchart depicting a process for manufacturing a foam-core mattress according to embodiments.

FIG. 5 is a flowchart depicting a process 500 for manufacturing a mattress, such as mattress 100 or 200 described herein. Process 500 begins at block 502 by combining a plurality of rebond foam pieces with a binder. This may be performed by feeding the pieces into a large container (possibly a mold) where the foam pieces are sprayed or otherwise mixed with the binder. The foam pieces may include a combination of foam pieces of different sizes, shapes, densities, and/or IFDs as described above in relation to core 102. Often, these may be pieces or remnants from other applications that can be repurposed rather than discarded. This often leads to the various sizes of pieces that may be used. For example, various pieces of remnant foams may be collected, then shredded down to smaller pieces.

For example, a subset of the foam pieces may have volumes of less than about 0.5 $in^3$, another subset may have volumes of between about 0.5 and 2.0 $in^3$, and a third subset may have volumes of greater than 2.0 $in^3$. Merely by way of example, these foam pieces may have a size in the range from about 0.25 inch by about 0.25 inch by about 0.25 inch to about 3 inches by about 3 inches by about 1 inch. The foam pieces may be selected from different density groups as well. For example, the core may be formed from a mixture of a fourth subset of foam pieces having densities of less than about 1.5 $lb./ft^3$, a fifth subset of foam pieces having densities of between about 1.5 and 2.2 $lb./ft^3$, and a sixth subset of foam pieces having densities of between about 2.2 and 3.0 $lb./ft^3$ (although some pieces with densities over 3.0 $lb./ft^3$ may be used in some embodiments). The core may also be constructed from pieces of foam having a variety of different IFDs. For example, the core may be formed from a mixture of a seventh subset of foam pieces having IFDs of between about 15 and 20, an eighth subset of foam pieces having IFDs of between about 20 and 30, and a ninth subset of foam pieces having IFDs of between about 30 and 40 (although some pieces with IFDs over 40 may be used in some embodiments). In some embodiments, the binder includes a combination of at least one polyol and at least one aromatic isocyanate (such as TDI and/or MDI), which may form a polyurethane binder to fill in voids between the individual foam pieces, as well as to bond the individual pieces together. In some embodiments, the core may include between about 80-98% by weight of rebond foam pieces and between about 2% and 20% by weight of the binder.

After the pieces are coated with the binder, they are fed into a mold (in some embodiments, the pieces may be fed into the mold during or before they are coated with the binder). For example, to facilitate the construction of a core that is to be used for a mattress, the foam pieces are placed within a rectangular mold. This mold may have various sizes depending on the desired size of the mattress. Merely by way of example, the mold may have a size in the range from about 60 inches by about 80 inches, with a height of about 3 feet to 4 feet. For larger mattresses, multiple cores may be bonded together. For example, two cores that are the size of a twin mattress could be bonded together at their sides to obtain the size and shape of a king sized mattress. At block 504, the binder-coated foam pieces may be compressed to form a loaf having an IFD of between about 21 and 36 and a density of between about 3.0 and 4.0 $lb./ft^3$. For example, a compression member that may be driven by a piston is used to compress the foam pieces to the desired density within the mold. Also, it will be appreciated that the density of the individual pieces will also contribute to the resulting density.

At block 506, heat is applied to the loaf within the mold to cure the binder. For example, the mold may be subjected to heat by introducing steam to the mold to cure the binder and allowed to cool. It will be appreciated that other forms of heat may be applied to the loaf to cure the binder. The resulting loaf is removed from the mold and has a rectangular shape. At block 508, this loaf may be sliced into multiple layers in order to form separate cores. Additional trimming to size may also be performed. At block 510, a foam core mattress may be assembled by attaching a base layer to a bottom surface of the core and attaching a cushion layer to a top surface of the core. For example, a cushion layer and base layer similar to those described above may be bonded or otherwise secured to respective sides of the core to form a mattress. In some embodiments, additional layers, such as ticking, an FR sock, mattress topper, mattress cover, and/or other layers, may be adhered, fastened, or otherwise secured to and/or around the cushion layer, core, and/or base layer.

After the mattress is assembled, it may be compressed and/or folded for shipping. For example, a piston and/or roller mechanism may apply a force of between about 50 to 75 tons (although other amounts of force may be used) to compress the mattress to remove excess air from the cells of the foam, allowing a mattress that is over 12 inches thick in an uncompressed state to be compressed to a thickness of less than 2 inches. In some embodiments, once compressed, the mattress may be folded. This compressed and/or folded mattress may then be rolled into a generally cylindrical shape. This allows the mattress, such as a queen size mattress having uncompressed dimensions of about 60 in×80 in×12 in, to fit within a package having dimensions of no larger than 64 in×21 in by 21 in (when only compressed and rolled) or 38 in×21 in×21 in (when compressed, folded, and rolled). The inclusion of the disclosed base may serve to prevent separation of any of the individual foam pieces of the core during the folding and/or rolling steps.

EXAMPLES

Mattresses made according to the various embodiments described herein were subjected to various tests in order to determine the firmness and fatigue resistance of the mattresses. The tests conducted are general protocol in the bedding industry. First, the firmness of the mattress is scanned and measured prior to any fatigue test. For this test (ASTM F1566-08), a 13.5" circular plate is depressed into the bed in about nine locations with a force of 175 pounds of pressure. The system records how many pounds of pressure that are required to depress the mattress to each 0.5 inch increment for each location. Next, a rollator (which is a 3 foot, six-sided, 240 pounds log) rolls back and forth across center of mattress for about 5,000 cycles. The mattress rests one hour and is scanned, which electronically measures any loss/gain of height. The ASTM test is conducted again as well. Additional cycles of 10,000, 25,000 cycles, 50,000 cycles, 75,000 cycles and 100,000 cycles are run, repeating the rest, scan & ASTM test. After the 100,000 cycle test, the mattress rests for 24 hours before returning to the ASTM F1566-08 test. It is believed that about 100,000 cycles approximates 10 years of use.

Exemplary results for selected tests are outlined below in Tables 1-3.

TABLE 1

Figure 6:
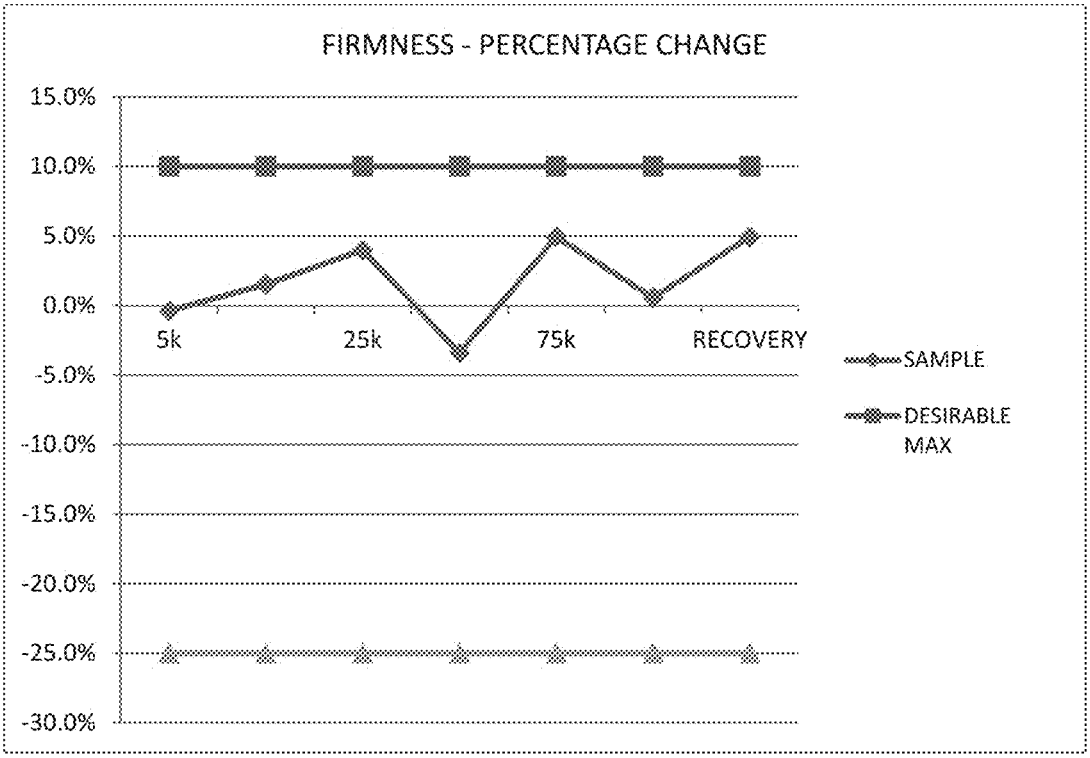
FIG. 6 depicts a firmness percentage change graph for a test mattress.

Mattress 1 (Core: 6.5 inches + 1 inch support foam layer as base layer; cushion layer: 3.5 inches (1.5 inch air insulated viscofoam with ventilating properties + 2 inches of regular viscofoam above core). The firmness percentage change of Mattress 1 is depicted in FIG. 6.

| | Pre test | 5k | 10k | 25k | 50k | 75k | 100k | Recovery test |
|---|---|---|---|---|---|---|---|---|
| Deflection | 4.73 | 4.46 | 4.40 | 4.43 | 4.43 | 4.30 | 4.33 | 4.30 |
| Load | 175 | 175 | 175 | 175 | 175 | 175 | 175 | 175 |
| Firmness (lb./in) | 37.0 | 39.2 | 39.8 | 39.5 | 39.5 | 40.7 | 40.4 | 40.7 |
| Height change (in inches) | | 0.05 | 0.06 | 0.13 | 0.12 | 0.12 | 0.13 | 0.14 |
| Height % change | | 0.4% | 0.5% | 1.1% | 1.0% | 1.0% | 1.1% | 1.2% |

TABLE 2

Figure 7:
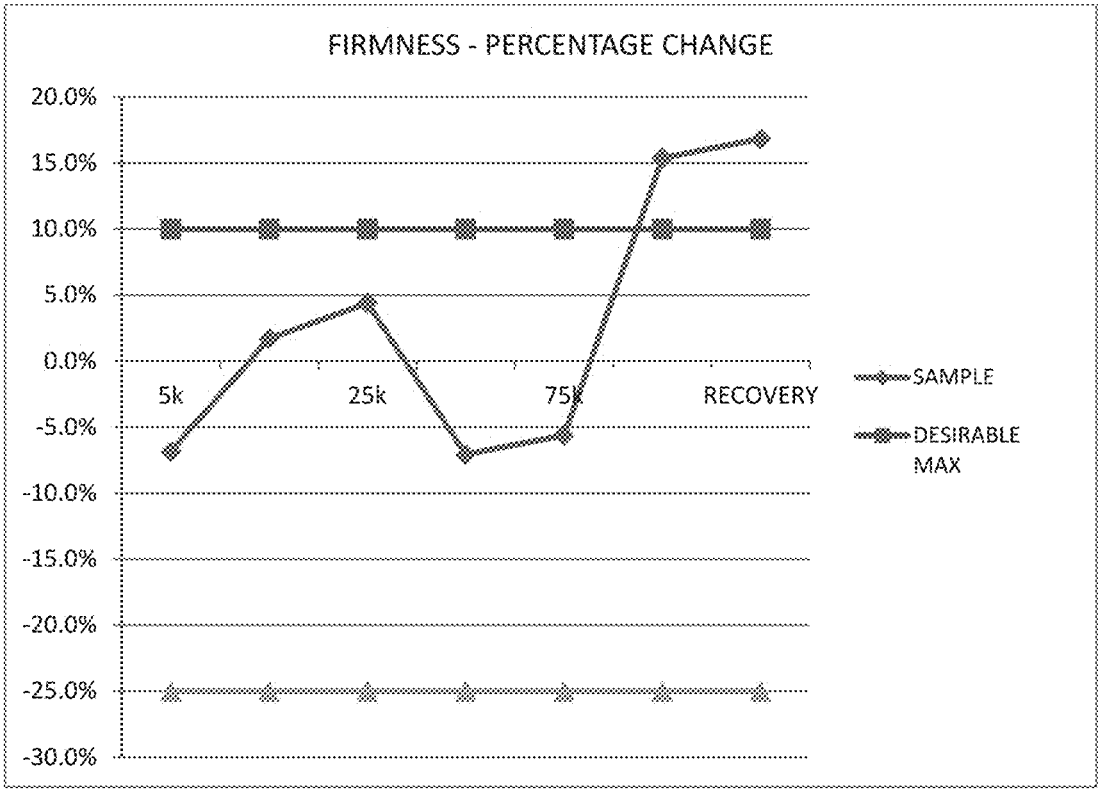
FIG. 7 depicts a firmness percentage change graph for a test mattress.

Mattress 2 (Core: 4.5" ES Core + 1" support foam; cushion layer: 3.5" 3 lbs ViscoElas Memory Foam + 1" ViscoElas Memory Foam topper). The firmness percentage change of Mattress 2 is depicted in FIG. 7.

| | pretest | 5k | 10k | 25k | 50k | 75k | 100k | Recovery test |
|---|---|---|---|---|---|---|---|---|
| Deflection | 4.76 | 4.8 | 4.7 | 4.6 | 4.5 | 4.6 | 4.7 | 4.5 |
| Load | 175 | 175 | 175 | 175 | 175 | 175 | 175 | 175 |
| Firmness (lb./in) | 37 | 37 | 38 | 38 | 39 | 38 | 38 | 39 |
| Height change (in inches) | | 0.13 | 0.10 | 0.02 | 0.08 | 0.08 | 0.09 | −0.01 |
| Height % change | | 1.3% | 1.0% | 0.3% | 0.8% | 0.9% | 0.9% | −0.1% |

TABLE 3

Figure 8:
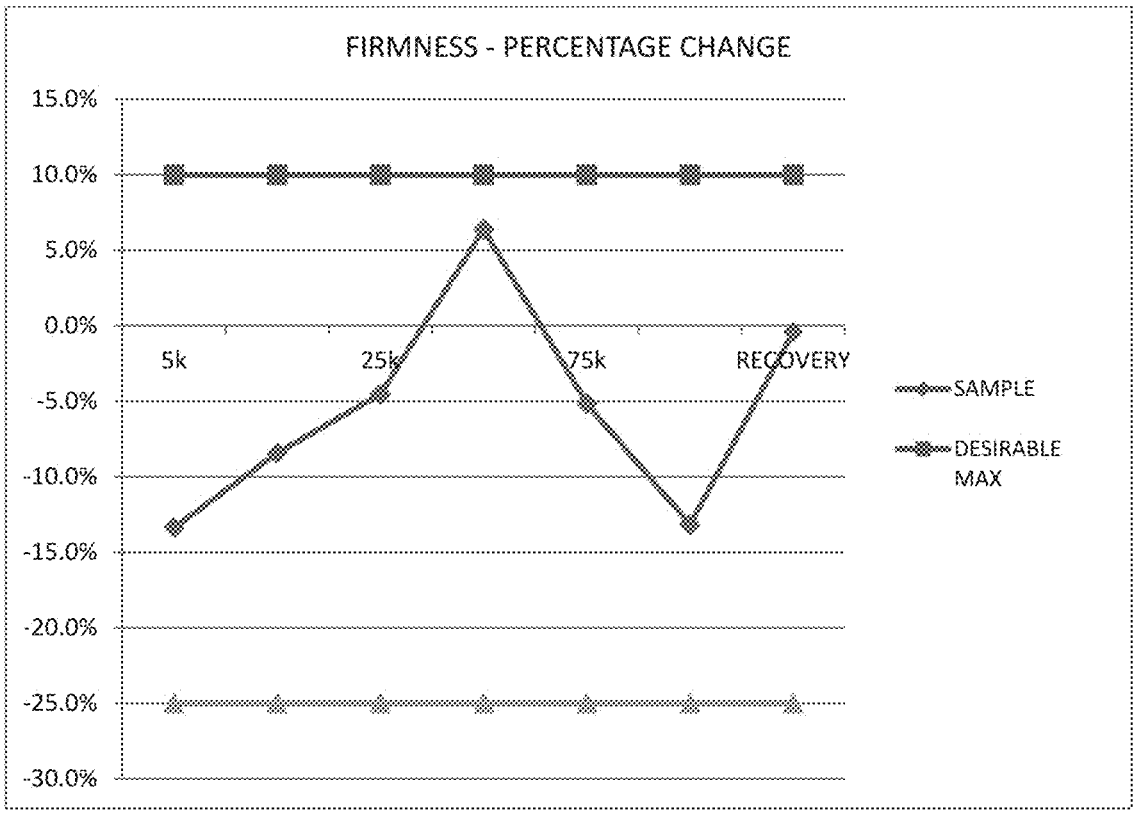
FIG. 8 depicts a firmness percentage change graph for a test mattress.

Mattress 3 (Core: 5.5" ES Core + 1" support foam; cushion layer: 3" 3 lbs ViscoElas Memory Foam + 1.5" Gel ViscoElas Memory Foam topper). The firmness percentage change of Mattress 3 is depicted in FIG. 8.

| | pretest | 5k | 10k | 25k | 50k | 75k | 100k | Recovery test |
|---|---|---|---|---|---|---|---|---|
| Deflection | 5.53 | 5.4 | 5.3 | 5.2 | 5.3 | 5.3 | 5.0 | 5.0 |
| Load | 175 | 175 | 175 | 175 | 175 | 175 | 175 | 175 |
| Firmness (lb./in) | 32 | 32 | 33 | 34 | 33 | 33 | 35 | 35 |

TABLE 3-continued

| Mattress 3 (Core: 5.5" ES Core + 1" support foam; cushion layer: 3" 3 lbs ViscoElas Memory Foam + 1.5" Gel ViscoElas Memory Foam topper). The firmness percentage change of Mattress 3 is depicted in FIG. 8. | | | | | | | | |
|---|---|---|---|---|---|---|---|---|
| | pretest | 5k | 10k | 25k | 50k | 75k | 100k | Recovery test |
| Height change (in inches) | | .03 | −0.05 | −0.01 | 0.04 | 0.04 | 0.01 | −0.05 |
| Height % change | | 0.3% | −0.4% | −0.1% | 0.4% | 0.4% | 0.1% | −0.6% |

The criticality of the disclosed parameters is further established by support testing. In these tests, a mattress having specifications matching the disclosed parameters ("Mattress A") is compared against a mattress with just slight variations from the disclosed parameters ("Mattress B"). Specifically, Mattress B has a core that has a lower density and a lower IFD than does Mattress A. This testing demonstrates the criticality of the various design considerations of a mattress, as the parameters of the various layers are clearly interdependent. Here, Mattress A included a 3 inch memory foam cushion layer having a density of between 1.8 lb./ft$^3$ to 3 lb./ft$^3$ and an IFD of 11, a 6 inch rebond foam core layer having a density of 3 lb./ft$^3$ to 3.8 lb./ft$^3$ and an IFD of 36, and a 1 inch base layer having a density of 2 lb./ft$^3$ and an IFD of 32. Mattress B included a 3 inch memory foam cushion layer having a density of between 1.8 lb./ft$^3$ to 3 lb./ft$^3$ and an IFD of 11 and a 7 inch rebond foam core layer having a density of 1 lb./ft$^3$ to 1.2 lb./ft$^3$ and an IFD of 15. Mattress B did not include a base. As the base in the claimed mattress is primarily to hold the rebond core intact during compression and shipping of the mattress, the omission of a base in Mattress B has minimal to no effect on the support and comfort performance of the test mattress, as the base is primarily used to protect the core during folding and/or rolling of the mattress during shipping operations.

Figure 9:
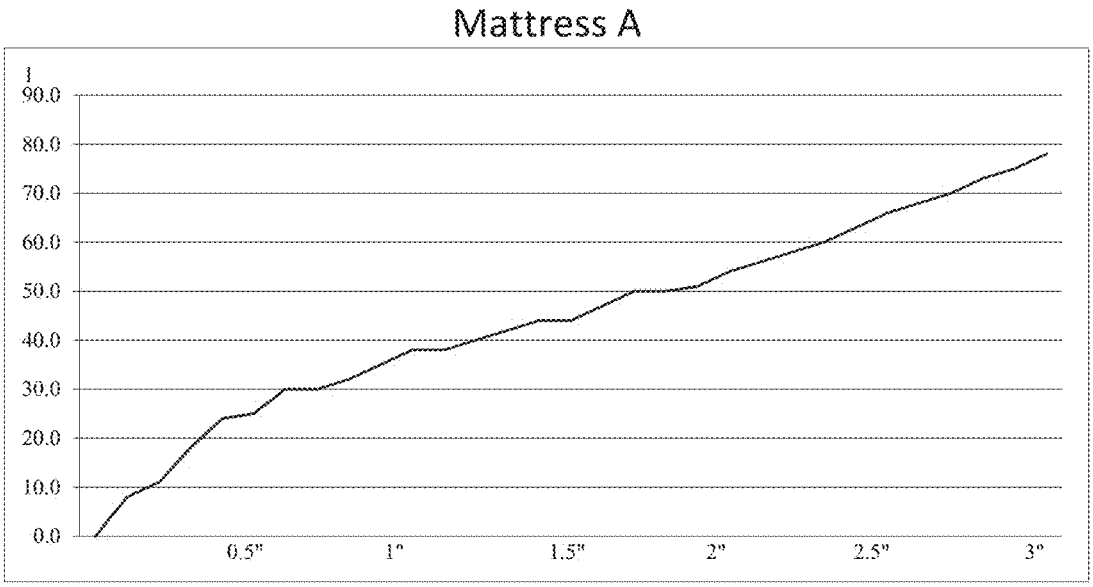
FIG. 9 depicts a support level graph of a test mattress.
Figure 10:
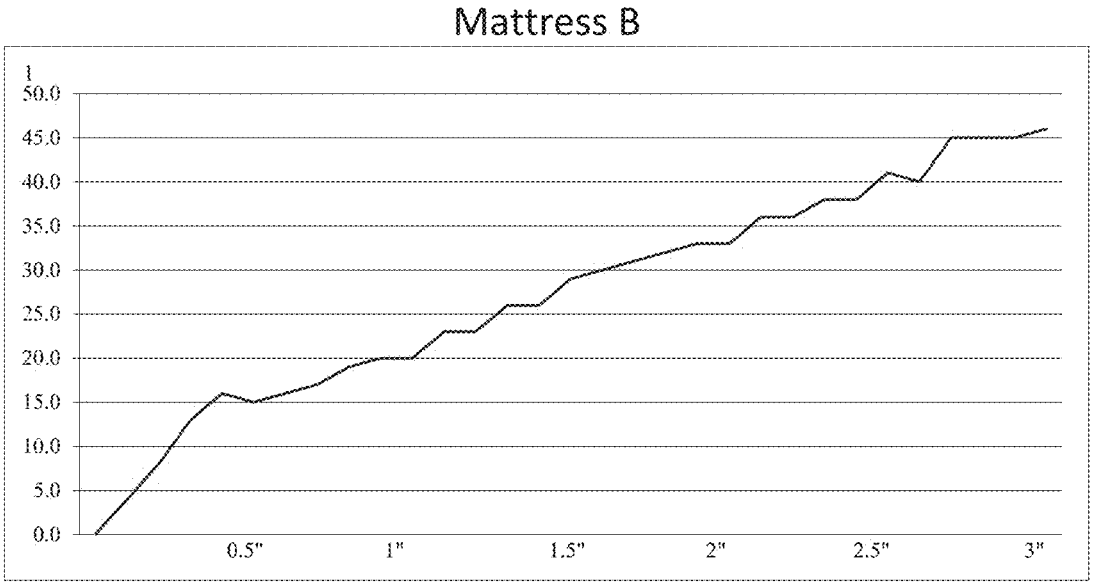
FIG. 10 depicts a support level graph of a test mattress.

The measurements of mattress parameters was performed according to ASTM F1566-08, which has been submitted herewith as Appendix A. The ASTM testing established that Mattress A had an overall ILD of 49, while Mattress B had an overall ILD of 33, thereby demonstrating the profound effect that small changes (outside of the claimed ranges) may have on the performance of a mattress. Specifically, by lowering the density and IFD of the core layer outside of the claimed ranges the mattress is significantly less supportive, as shown in the FIGS. 9 and 10 (with the raw data being included as Appendix B).

Here, the firmness/support level is shown on the Y-axis, with a depth of compression shown on the X-axis. It is very clear that Mattress A provides significantly more support than Mattress B, while still providing sufficient comfort. Based on such data, it is clear that adjusting a parameter of one layer of a mattress in an attempt to make a mattress more comfortable has in a notable effect on the spinal support characteristics of the mattress. In other words, the proper balance of these parameters for each layer involves a very complex analysis of how a change in one layer will affect the mattress as a whole. Not only are these ranges critical in producing optimal test results, but these ranges are imperative to providing desired comfort and support characteristics for people over a wide range of sizes and weights, as is discussed in more detail in relation to FIGS. 11-18.

The reduction in support of Mattress B is further demonstrated by human testing. Achieving a balance between spinal support and comfort is absolutely critical, as providing a mattress that is too soft will result in the hips sinking too much (preventing proper spinal alignment), while providing a mattress that is too hard will result in the arms and/or shoulders falling asleep. As seen in the FIGS. 11-14, the variation of density and IFD between the two tested mattresses provides a stark contrast in sleep characteristics of a mattress.

Figure 11:
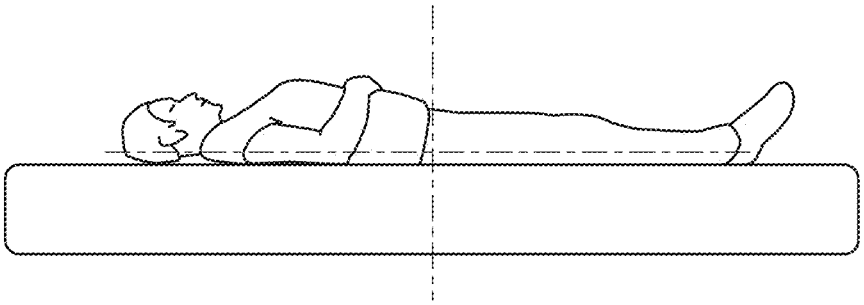
FIG. 11 depicts spinal alignment results for a test mattress.
Figure 12:
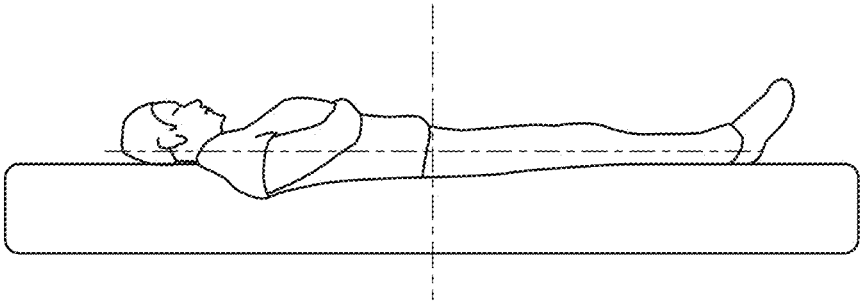
FIG. 12 depicts spinal alignment results for a test mattress.

The trials depicted in FIGS. 11 and 12 involved a 5'7", 165 pound female subject in a back sleeping position. In FIG. 11, the laser alignment shows that on Mattress A the subject's back, the neck, shoulders, spine, hips, and ankles are in substantial alignment. In contrast, when on Mattress B, the subject's shoulders sink significantly into the mattress such that the spine is misaligned as shown in FIG. 12.

Figure 13:
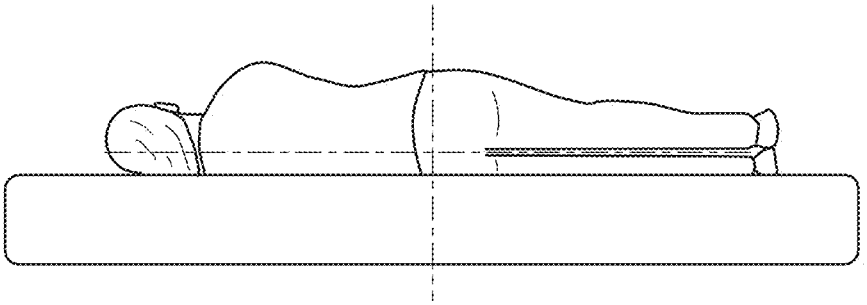
FIG. 13 depicts spinal alignment results for a test mattress.
Figure 14:
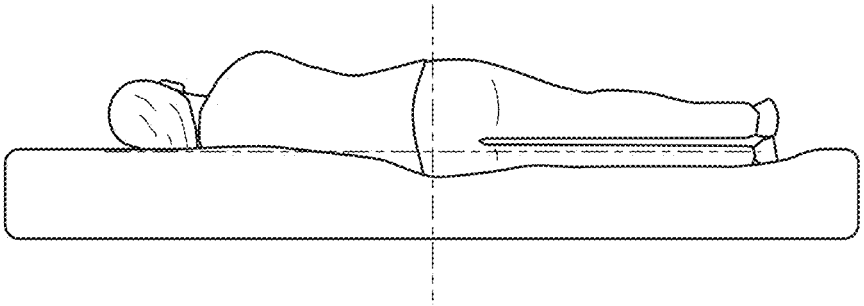
FIG. 14 depicts spinal alignment results for a test mattress.

The trials depicted in FIGS. 13 and 14 involved a 5'1", 138 pound female subject in a side sleeping position. As shown in FIG. 13, Mattress A when in the side sleeping position, the subject's spine is aligned with a center of the subject's lower body.

In the side sleeping position, Mattress B allows the subject's hips to sink significantly into the mattress, resulting in a pronounced curve of the spine as shown in FIG. 14.

Figure 15:
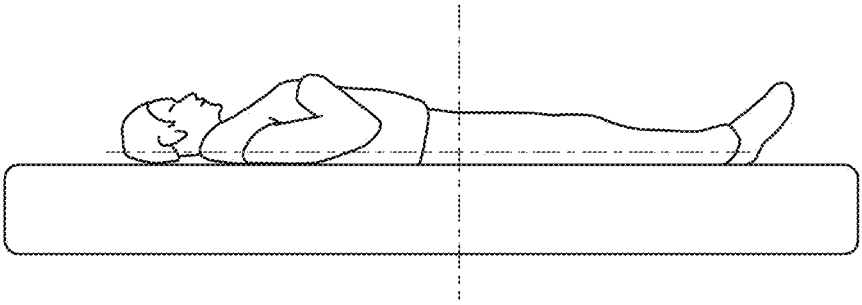
FIG. 15 depicts spinal alignment results for a test mattress.
Figure 16:
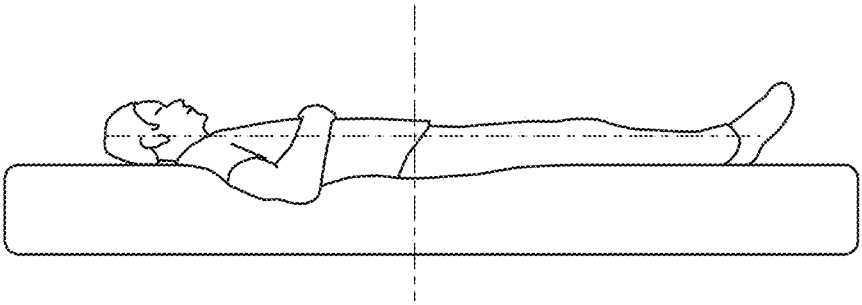
FIG. 16 depicts spinal alignment results for a test mattress.
Figure 17:
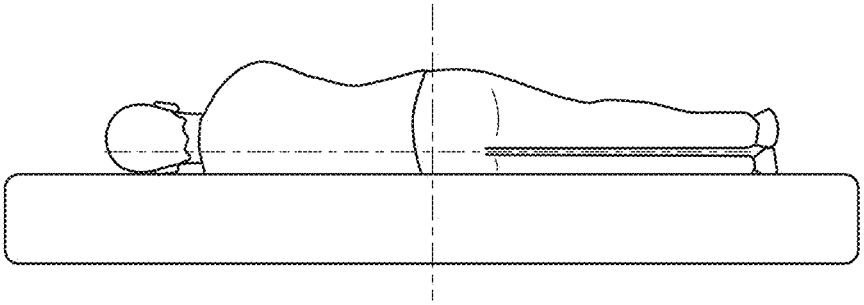
FIG. 17 depicts spinal alignment results for a test mattress.
Figure 18:
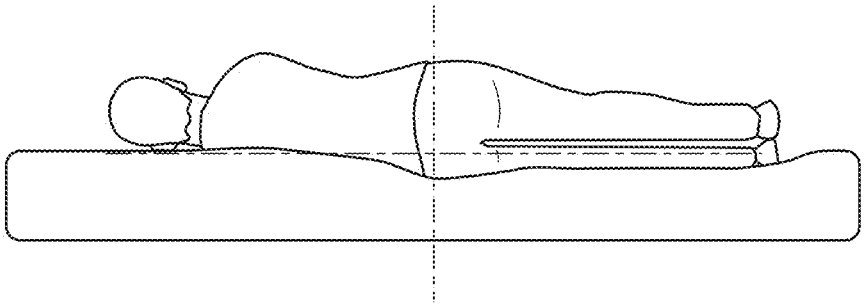
FIG. 18 depicts spinal alignment results for a test mattress.

The trials depicted in FIGS. 15-18 involved a male subject in both a back sleeping position and a side sleeping position. In FIG. 15, the laser alignment shows that on Mattress A the subject's back, the neck, shoulders, spine, hips, and ankles are in substantial alignment in the back sleeping position. In the side sleeping position, the subject's spine is aligned with a center of the subject's lower body as shown in FIG. 16. In contrast, when on Mattress B, the subject's shoulders and hips sink significantly into the mattress such that the spine is misaligned and the subject's head is projected forward, straining the neck while in the back sleeping position as shown in FIG. 17. In the side sleeping position shown in FIG. 18, Mattress B allows the subject's shoulders and hips to sink significantly into the mattress, resulting in a pronounced curve of the spine.

These images clearly demonstrate that Mattress A (within the disclosed parameters) provides a sufficiently soft mattress (as indicated by the slight sinking down of the user into the mattress) while providing exceptional spinal support and alignment (as shown by the alignment of the spine using the laser alignment guide). Specifically, the laser alignment guide demonstrates that for the users laying on their backs, the neck, shoulders, spine, hips, and ankles are in substantial alignment while with side sleepers the spine remains in alignment with the middle of the person's legs. The comfort and support characteristics consistently hold true for Mattress A with human testers of sleep positions, various heights, weights, body shapes, and genders as is clearly seen in each set of photos. Mattress A provides an excellent combination of parameters to assure proper comfort and spinal support characteristics. In contrast, Mattress B (with a core outside the claimed parameters) provides a mattress that fails to provide sufficient support (as shown by the misalignment of the spine using the laser alignment guide). Again, these characteristics are consistently poor for human testers of sleep positions, various heights, weights, body shapes, and genders as is clearly seen in each set of photos. While Mattress B includes lower density and IFD values for the core layer, a hypothetical Mattress C having density and IFD levels above the claimed ranges would provide opposite results. Specifically, Mattress C would provide considerable support, but would allow for little to no sinking of any of the body, which would cause excessive pressure and discomfort to the user, oftentimes resulting in one or more limbs falling asleep. Given this evidence, it is clear that each parameter of the mattress, such as the density or IFD of a particular layer is critical to the overall function of the mattress and must be carefully selected based on a consideration of the design of each of the other layers to arrive at a combination of layers that provides a mattress with the desired comfort and support characteristics.

Figure 19:
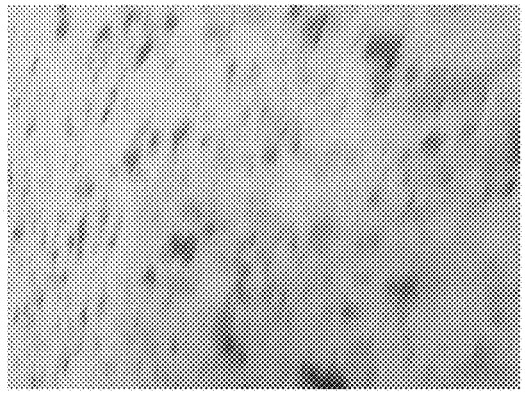
FIG. 19 depicts a condition of core layer of an inventive mattress after being subjected to folding and rolling according to embodiments.
Figure 20:
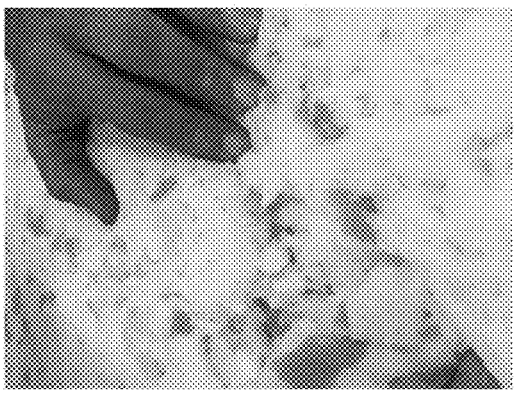
FIG. 20 depicts a condition of core layer of a normal mattress after being subjected to folding and rolling according to embodiments.

As noted above, Mattress B does not include a base. A primary purpose of the base is to provide durability to the mattress, especially during rolling and shipment of the mattress. To demonstrate the importance and criticality of the base layer having the claimed parameters, the ASTM testing (which includes applying test forces to the mattress using a 240 lb. roller over 100,000 cycles) was performed on Mattress B with the mattress upside down to simulate the forces of rolling and shipping the mattress. FIG. 19 depicts the intact rebond core prior to the ASTM testing, while FIG. 20 image shows the rebond core beginning to crumble after being subjecting to the testing forces.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. It should be noted that the systems and methods discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

The methods, systems, graphs, and tables discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims. Additionally, the techniques discussed herein may provide differing results with different types of context awareness classifiers.

While illustrative and presently preferred embodiments of the disclosed systems and methods have been described in detail herein, it is to be understood that the inventive concepts may be otherwise variously embodied and employed, and that the appended claims are intended to be construed to include such variations, except as limited by the prior art.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, methods, and other implementations described herein. As used herein, including in the claims, "and" as used in a list of items prefaced by "at least one of or" one or more of indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A foam core mattress, comprising:

a cushion layer comprising a foam having an IFD of between about 6 to about 18 and a density of between about 1.8 lb./ft$^3$ to about 3 lb./ft$^3$, wherein the cushion layer has a thickness of between about 1 and 4 in.;

a core that is coupled with a bottom surface of the cushion layer, the core comprising a matrix of rebond foam pieces that includes foam pieces having volumes of less than about 0.5 in$^3$, foam pieces having volumes of between about 0.5 and 2.0 in$^3$, and foam pieces having volumes of greater than 2.0 in$^3$, wherein the core has an IFD of between about 28 and 65, wherein the core has a thickness of between about 3 and 8 in. and a density of between about 3 lb./ft$^3$ to about 3.8 lb./ft$^3$; and a base layer coupled with a bottom surface of the core, the base layer having an IFD of between about 28 to about 70 and a density of between 1.5 lb./ft$^3$ to about 2 lb./ft$^3$, wherein the base layer has a thickness of between about 0.75 and 1.5 in.

2. The foam core mattress of claim 1, wherein:

the core comprises between about 80-98% by weight of rebond foam pieces and between about 2% and 20% by weight of a binder.

3. The foam core mattress of claim 1, wherein:

the foam of the cushion layer comprises one or both of airfoam or gelfoam.

4. The foam core mattress of claim 1, wherein:

a top surface of the cushion layer comprises a phase change material.

5. The foam core mattress of claim 1, wherein:

the matrix of rebond foam pieces comprises at least 35% foam pieces having densities between about 1.5 and 2.2 lb./ft$^3$, at least 40% foam pieces having densities between about 2.2 and 3.0 lb./ft$^3$, and at least 2% foam pieces having densities of less than about 1.5 lb./ft$^3$.

6. A foam core mattress, comprising:

a cushion layer comprising a foam having an IFD of between about 6 to about 18 and a density of between about 1.8 lb./ft$^3$ to about 3 lb./ft$^3$, wherein the cushion layer has a thickness of between about 2 and 4.5 inches;

a core that is coupled with a bottom surface of the cushion layer, the core comprising a matrix of rebond foam pieces that includes foam pieces having volumes of less than about 0.5 in$^3$, foam pieces having volumes of between about 0.5 and 2.0 in$^3$, and foam pieces having volumes of greater than 2.0 in$^3$, wherein the core has an IFD of between about 28 and 65, wherein the core layer has a thickness of between about 3 and 8 inches and a density of between about 3 lb./ft$^3$ to about 3.8 lb./ft$^3$; and a base layer coupled with a bottom surface of the core, the base layer having an IFD of between about 28 to about 70 and a density of between 1.5 lb./ft$^3$ to about 2 lb./ft$^3$, wherein the base layer has a thickness of between about 0.5 and 2 inches.

7. The foam core mattress of claim 6, wherein:

the rebond foam pieces comprise a first subset of foam pieces having IFDs of between about 15 and 20, a second subset of foam pieces having IFDs of between about 20 and 30, and a third subset of foam pieces having IFDs of between about 30 and 40.

8. The foam core mattress of claim 6, wherein:

the matrix of rebond foam pieces includes at least 5% foam pieces having volumes of less than about 0.5 in$^3$, at least 40% foam pieces having volumes of between about 0.5 and 2.0 in$^3$, and at least 20% foam pieces having volumes of greater than 2.0 in$^3$.

9. The foam core mattress of claim 6, wherein:

the rebond foam pieces comprise polyurethane, urethane, or a combination thereof.

10. The foam core mattress of claim 6, further comprising:

a removable cover positioned around an entirety of the cushion layer, the core, and the base layer.

11. The foam core mattress of claim 10, wherein:

at least a portion of the removable cover comprises a phase change material.

12. The foam core mattress of claim 6, wherein:

the cushion layer comprises a plurality of layers of different materials.

13. A method of constructing a foam core mattress, comprising:

combining a plurality of rebond foam pieces with a binder, wherein the plurality of rebond foam pieces comprise foam pieces having volumes of less than about 0.5 in$^3$, foam pieces having volumes of between about 0.5 and 2.0 in$^3$, and foam pieces having volumes of greater than 2.0 in$^3$, wherein the binder comprises a polyurethane formed from a combination of at least one polyol and at least one aromatic isocyanate that fills in voids between the foam pieces;

compressing the combined plurality of rebond foam pieces and the binder in a mold to form a loaf having an IFD of between about 28 and 65, a thickness of between about 3 and 8 in., and a density of between about 2.0 and 5.0 lb./ft$^3$;

applying heat to the loaf to cure the binder;

cutting the loaf to form a core; and assembling the foam core mattress by attaching a base layer to a bottom surface of the core and attaching a cushion layer to a top surface of the core, wherein:

the cushion layer has an IFD of between about 6 to about 18, a density of between about 1.8 lb./ft$^3$ to about 3 lb./ft$^3$, and a thickness of between about 1 and 4 in.; and the base layer an IFD of between about 28 to about 70, a density of between 1.5 lb./ft$^3$ to about 2 lb./ft$^3$, and a thickness of between about 0.75 and 1.5 in.

14. The method of constructing a foam core mattress of claim 13, wherein:

the binder comprises a combination of at least one polyol and at least one aromatic isocyanate.

15. The method of constructing a foam core mattress of claim 13, wherein:

the core comprises between about 80-98% by weight of rebond foam pieces and between about 2% and 20% by weight of the binder.

16. The method of constructing a foam core mattress of claim 13, further comprising:

applying a force of between about 50 and 75 tons to the assembled foam core mattress to compress the assembled foam core mattress.

17. The method of constructing a foam core mattress of claim 16, further comprising:

rolling the compressed foam core mattress into a generally cylindrical shape without any separation of the foam pieces from the mattress.

* * * * *